US008968157B2

(12) United States Patent
Lindstrom

(10) Patent No.: US 8,968,157 B2
(45) Date of Patent: Mar. 3, 2015

(54) HURDLE WITH AUTOMATIC DISPLACEMENT OF COUNTERWEIGHTS

(75) Inventor: Goran Lindstrom, Akersberga (SE)

(73) Assignee: Rantzows Sport AB, Hjamarp (SE)

( * ) Notice: Subject to any disclaimer, the term of this patent is extended or adjusted under 35 U.S.C. 154(b) by 167 days.

(21) Appl. No.: 13/695,637

(22) PCT Filed: Apr. 28, 2011

(86) PCT No.: PCT/SE2011/000073

§ 371 (c)(1),
(2), (4) Date: Nov. 1, 2012

(87) PCT Pub. No.: WO2011/139197

PCT Pub. Date: Nov. 10, 2011

(65) Prior Publication Data

US 2013/0053219 A1 Feb. 28, 2013

(30) Foreign Application Priority Data

May 3, 2010 (SE) ..... 1000441

(51) Int. Cl.
*A63B 1/00* (2006.01)
*A63B 5/02* (2006.01)
*A63K 3/04* (2006.01)

(52) U.S. Cl.
CPC ..... *A63K 3/043* (2013.01)
USPC ..... 482/17; 482/38

(58) Field of Classification Search
CPC ..... A63B 1/00
USPC ..... 482/14–18, 23, 38; 119/702, 705
See application file for complete search history.

(56) References Cited

U.S. PATENT DOCUMENTS 1,128,705 A * 2/1915 Medart ..... 482/17
1,910,080 A * 5/1933 Austin ..... 482/17
1,982,934 A * 12/1934 Squire ..... 482/16

(Continued)

FOREIGN PATENT DOCUMENTS

EP 0792670 9/1997
FR 1116538 5/1956

(Continued)

OTHER PUBLICATIONS

International Search Report dated Jul. 22, 2011, corresponding to PCT/SE2011/000073.

*Primary Examiner* — Loan H Thanh
*Assistant Examiner* — Garrett Atkinson
(74) *Attorney, Agent, or Firm* — Young & Thompson

(57) ABSTRACT

A hurdle includes two base parts, each base part having a hollow space; a counterweight; a gear transmission arranged in each base part to displace the counterweight; tubular elements that include first second tubes displaceable telescopically relative to one another, each of the first tubes being fixed to one of the base parts; locking elements that lock the first and second tubes relative to one another; a bar connecting upper ends of the second tubes; a force-transmitting unit that extends from the hollow space in each base part and is connected to an associated second tube; and guides arranged in each base part, where the gear transmission engages both with the force-transmitting unit and with a driver for the counterweight, where the force-transmitting unit is received in the guides, and where the gear transmission is adapted to cooperate with openings provided in the force transmitting unit.

15 Claims, 3 Drawing Sheets

(56) References Cited

U.S. PATENT DOCUMENTS

| | | | | | |
|---|---|---|---|---|---|
| 2,119,808 | A | * | 6/1938 | Fecht | 482/16 |
| 2,583,786 | A | * | 1/1952 | Marzucco | 482/17 |
| 2,706,631 | A | * | 4/1955 | Holmes | 482/17 |
| 2,884,252 | A | * | 4/1959 | Thompson | 473/477 |
| 3,384,367 | A | * | 5/1968 | Baum | 482/17 |
| 3,394,932 | A | * | 7/1968 | Leflar | 482/17 |
| 3,877,421 | A | * | 4/1975 | Brown | 601/23 |
| 4,749,187 | A | * | 6/1988 | Dellinger et al. | 482/17 |
| 5,199,930 | A | * | 4/1993 | Weber | 482/17 |
| 5,289,782 | A | * | 3/1994 | Rizzi et al. | 108/147 |
| 6,220,185 | B1 | * | 4/2001 | Pontoppidan | 108/147 |
| 7,438,668 | B1 | * | 10/2008 | Watry et al. | 482/17 |
| 2009/0044735 | A1 | * | 2/2009 | Nielsen | 108/147.19 |

FOREIGN PATENT DOCUMENTS

| | | |
|---|---|---|
| FR | 2483796 | 12/1981 |
| JP | 82 99615 | 11/1996 |

* cited by examiner

HURDLE WITH AUTOMATIC DISPLACEMENT OF COUNTERWEIGHTS

TECHNICAL FIELD OF THE INVENTION

This invention relates to a hurdle for hurdle racing as an event in athletics. The hurdle described is a more advanced type with automatic displacement of its counterweights, thereby facilitating operation for the adjustment of different heights for the bar over which the hurdler is to jump. The hurdle specified complies with international competition rules, stipulating, inter alia, the different heights for the bar, as well as the overturning resistance applying in competitive hurdle racing, etc.

STATE OF THE ART

This description relates principally to hurdles approved for competition, although there are also many simpler hurdles designed for training children, etc.

The most common type of approved hurdle is made of a number of metal tubes which, when viewed from one side, are formed into the shape of an L the foot of which rests on the ground, is 60-70 cm long and contains displaceable counterweights.

At one end of the foot resting on the ground is a vertical tube telescopically coupled to a vertically adjustable tube situated thereabove. Parallel to this, at a distance of approximately 1.1-1.2 m, is an equivalent L-section and the two sides are connected together at the bottom by a tube between the corners of the two L-sections and are connected together at the top by a rail referred to as a "bar" usually made of plastic or wood. The bar is vertically adjustable, usually having 5 fixed locking positions for specific heights measured from the underside of the foot to the upper edge of the bar over which the hurdler is to jump. The hurdler runs towards the hurdle in order to jump over its bar situated at the top of the far end of the hurdle as viewed by the runner.

If the bar is struck, e.g. by the foot of the hurdler, the hurdle may tip over and it is thus extremely important that the force required to tip the hurdle over (overturning resistance) is identical (35-39 N) irrespective of the height of the bar. The counterweights in the base part are thus usually displaced manually to this end between different positions as the height of the bar is changed. The counterweights are displaced backwards (against the running direction) when the bar is displaced upwards and forwards when the bar is displaced downwards. In most types of hurdle, the counterweights are displaced manually as the bar is displaced upwards or downwards. The height of the bar and the horizontal position of the counterweights must correspond for the overturning resistance always to be the same, but sometimes one of the counterweights is inadvertently placed in the wrong position in relation to the set height, as a result of which the overturning resistance of the hurdle is incorrect, meaning that officials often have to check the settings at competitions, at great inconvenience.

Another type of hurdle operates in such a manner that the counterweights are displaced automatically when the height of the bar is changed, thereby simplifying adjustment and eliminating the risk of any counterweight inadvertently being placed in the wrong position. Reference should be made to U.S. Pat. No. 4,749,187, in which the counterweight can be displaced with the aid of a cable, one end of which is secured to the upper telescopically vertically adjustable tube and extends into the lower corner of the hurdle backwards at a right angle via a pulley. The cable then bypasses the counterweight, turns via another pulley in the rearmost part of the foot and turns back again via a pulley on the rearmost part of the counterweight in order then to be secured in the rearmost part of the foot. This means that when the bar is raised upwards, the counterweight is displaced backwards with a fixed ratio, meaning that it moves half the distance by which the bar is displaced in the vertical direction. In order to allow the counterweight to move forwards when the bar is lowered downwards, a tension spring is mounted between the front edge of the counterweight and in the lower and front corner of the hurdle. As the same type of device is situated on both sides of the hurdle, this means that two springs have to be extended when the bar is displaced upwards, which in turn means that great force is usually required to displace the bar upwards, particularly into its uppermost position when the springs are extended to the maximum degree. Another disadvantage of this design is that the counterweight is displaced exactly 50% of the distance by which the bar is displaced, which may make it more difficult to achieve overturning resistance of exactly the same magnitude irrespective of the height of the bar. A more optimal ratio for constant overturning resistance means that the counterweight should move approximately 60-70% of the distance by which the bar is displaced in the vertical direction.

Reference should also be made to Japanese Patent Application No. JP 82 99615 also describing a hurdle with automatic displacement of the counterweights, although the images of this application show that the counterweights are displaced in the wrong direction, meaning that the desired aim of constant overturning resistance cannot be achieved. The gear transmission is disposed in the vertical tubes, where there is not normally much space, in order then to transfer the force at right angles to the counterweight via a cable. Although a cable in a casing usually works well in connection with pulling, it works less well in connection with a pushing force with one end of the cable outside its casing, particularly over a longer distance, normally approximately 200-250 mm in the case of a hurdle, meaning that the cable tends to bend or to be deformed.

AIMS AND FEATURES OF THE INVENTION

One aim of this invention is to provide an automatic hurdle in which the bar can be displaced upwards or downwards using relatively little force which is constant for the entire movement.

Another aim of this invention is for the manufacturing process to allow the ratio between the displacement of the bar and the counterweights to be substantially infinitely adjustable in order to achieve the most precise overturning resistance possible for the different possible heights for the bar.

Yet another aim of this invention is for the hurdle to have a simple design so that manufacturing costs can be kept low.

DETAILED DESCRIPTION OF A PREFERRED EMBODIMENT OF THE HURDLE ACCORDING TO THIS INVENTION

Figure 2:
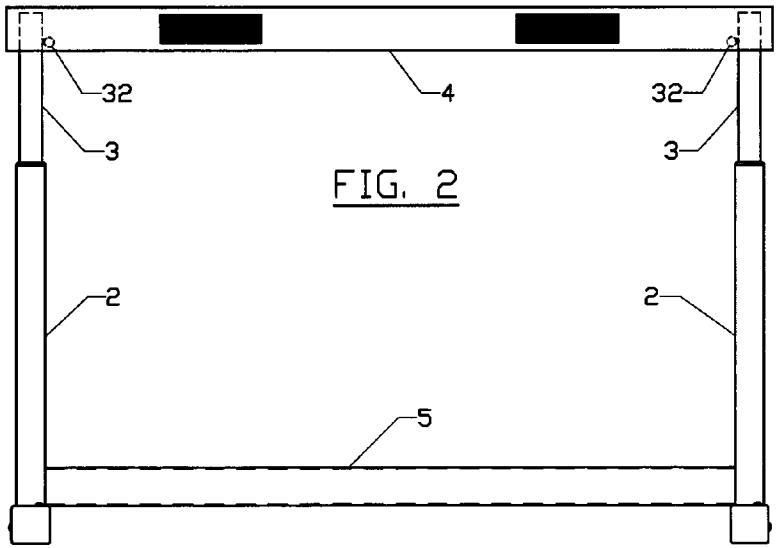
FIG. 2 is a front view of the hurdle, as viewed by the hurdler.
Figure 3:
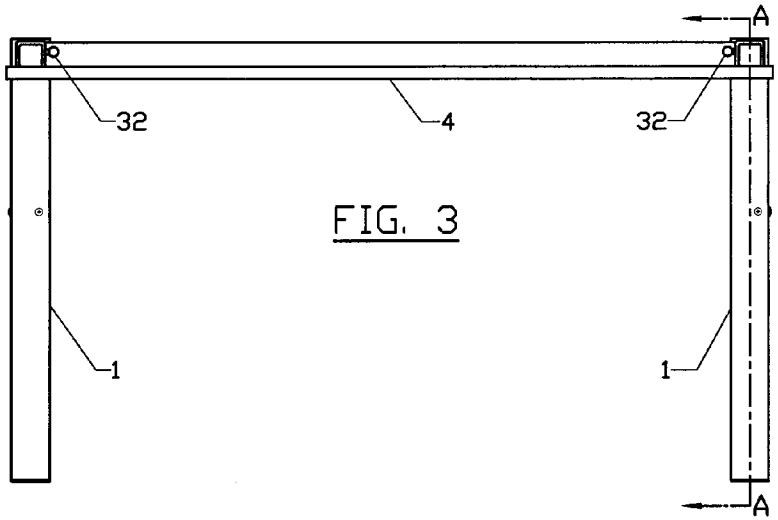
FIG. 3 is a top view of the hurdle.
Figure 1:
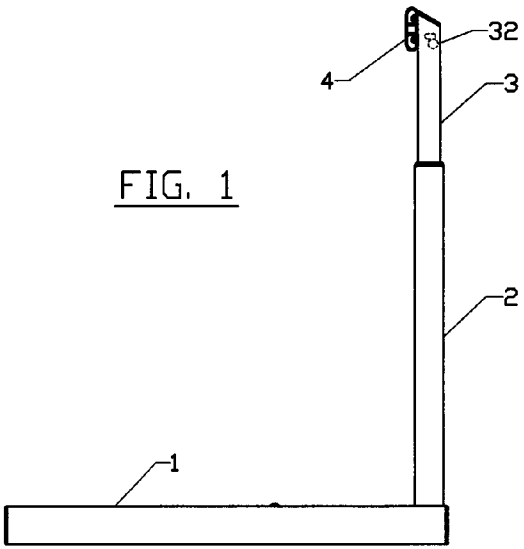
FIG. 1 is a side view of the hurdle.

The hurdle shown in FIGS. 1-3 includes a tubular base part 1, referred to as a foot, which rests on the ground and a vertical tube 2 secured to the front end of the foot 1. Partly above the tube 2 is a tube 3 which is telescopically vertically adjustable and forms a fastener for the bar 4 which is thus vertically adjustable. When viewed from one side of the hurdle, these parts together form the shape of an L both sides of which are designed in the same manner and are rigidly connected together at the bottom by means of a cross member 5 and at the top by the bar 4.

The hurdler runs towards the hurdle from left to right according to FIG. 1 in order to jump over the bar 4.

Figure 5:
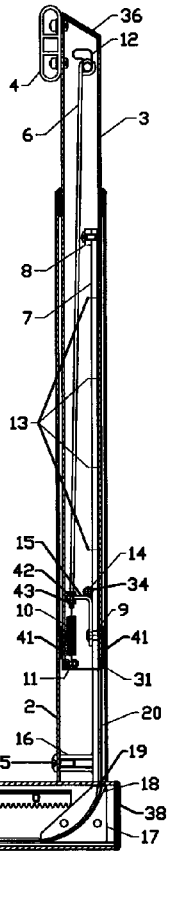
FIG. 5 is a partly sectional side view of FIG. 3 along the line A-A with the bar in its lowermost position.
Figure 4:
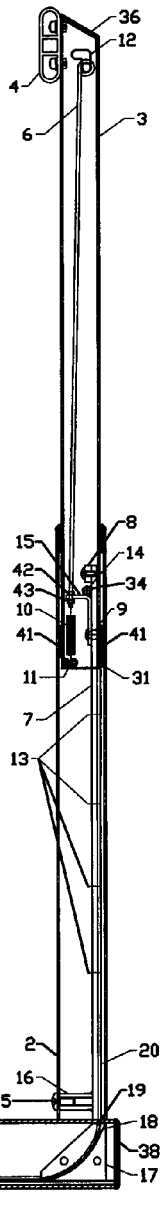
FIG. 4 is a partly sectional side view of FIG. 3 along the line A-A with the bar in its uppermost position.

FIGS. 4-5 include the same components with the bar at its highest height in FIG. 4 and at its lowest height in FIG. 5. The figures also show, inter alia, how the counterweight 25 in the foot 1 is situated in the rear position, i.e. on the left when the bar is situated at a high height, and in the front position, on the right when the bar is situated at a low height, so that the overturning resistance will be identical irrespective of the height of the bar.

Figure 7:
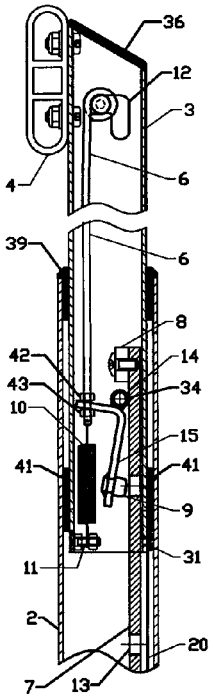
FIG. 7 is an enlarged view of the upper parts of the hurdle of FIGS. 4-5 with the locking mechanism in the released position.
Figure 6:
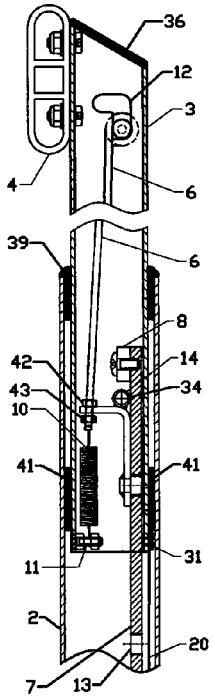
FIG. 6 is an enlarged view of the upper parts of the hurdle of FIGS. 4-5 with the locking mechanism in the locked position.
Figure 8:
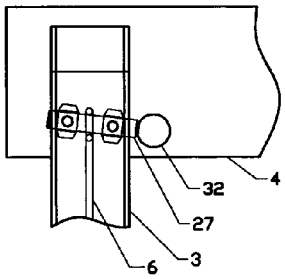
FIG. 8 is a back view of one uppermost corner of the hurdle.
Figure 8:
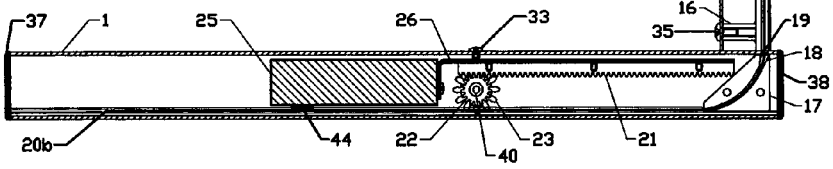
Figure 8:
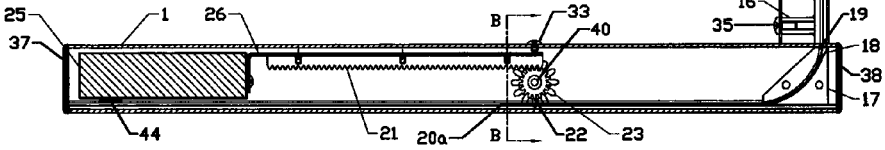
Figure 9:
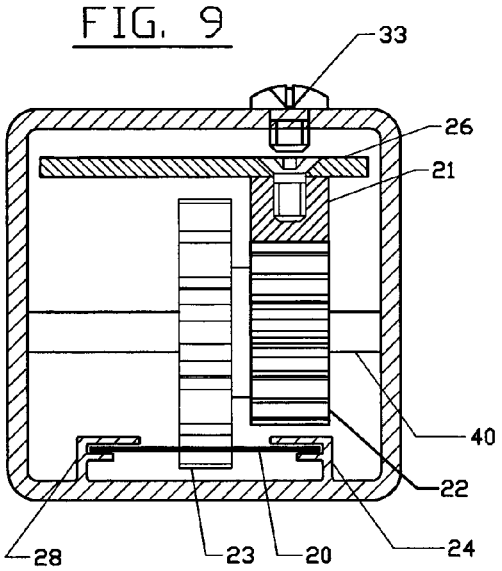
FIG. 9 is an enlarged view along the line B-B of FIG. 4.
Figure 10:
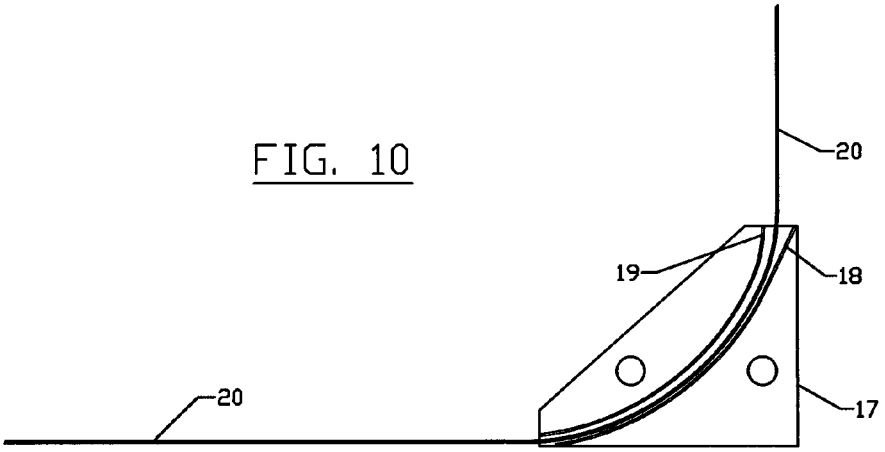
FIG. 10 is an enlarged view of the corner component 17 and part of component 20.

The following detailed description of its function describes only one side of the hurdle, but the same thing applies in the same manner to the other side of the hurdle, which is designed in the same manner:

FIGS. 6-8 show that when the bar is to be displaced upwards or downwards, the bar 4 is grasped by the hand while one finger simultaneously raises slightly the ball handle 32 secured to the tubular pin 27 which is vertically adjustable and can be moved in the lateral direction into its uppermost position via the opening 12 on one side of the tube 3. The tension rod 6 is then raised upwards by a few mm, the locking arm 15 with its locking pin 9 then releasing the upper tube 3 from its locked position so that the tube 3 with the bar 4 can be raised or lowered. The locking arm 15 is rotatable via its welded tube 14 rotated about an axle 34 secured to the tube 3. The flat bar 7 welded to the internally threaded rod 16 is secured to the tube 2 via the screw 35. The flat bar 7 has at least five through holes 13 for locking the various fixed height positions with the aid of the locking pin 9 pressed into one of the holes. By virtue of the fact that the flat bar 7 with its holes 13 is arranged inside the tubes 2, 3, no dust or dirt can get into the tubes 2, 3 via the holes 13 which are hermetically sealed by the tubes 2, 3.

The opening 12 in one side of the upper tube 3 delimits the upward and downward movement of the pin 27 with its ball handle 32, but also means that, in its upper position, the pin 27 can be moved at a right angle in the lateral direction towards the bar 4 in order to remain in this position so that the bar can be displaced in the vertical direction without the ball handle 32 simultaneously having to be held firm. When the ball handle 32 is then turned back in the lateral direction away from the bar 4, the locking arm 15 then moves the locking pin 9 into the flat bar 7 with the aid of spring force from the tension spring 10 as soon as the bar 4 is displaced in the vertical direction so that the locking pin 9 strikes one of the approximately five (5) holes 13 in the flat bar 7, the height setting of the bar thus being in a locked position. At the same time as this locking operation, the ball handle 32 is also moved into its lower position by the tension spring 10, the upper end of which is secured to the lowermost part of the tension rod 6 and the lower end of which is secured in the screw 11 secured to the lowermost part of the tube 3. The tension rod 6 controls the locking arm 15 in that the nuts 42-43 are secured to the tension rod 6 with a certain play between the respective nuts and the locking arm 15.

Figure 11:
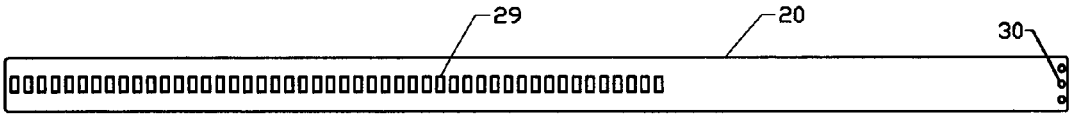
FIG. 11 is a top view of component 20.

A force-transmitting means in the form of a steel strip 20 (see FIG. 11) is made of a thin, highly flexible spring steel having a thickness of approximately 0, 4 mm and a width of approximately 35 mm. The force-transmitting means is flexible in only one plane as viewed at right angles to the plane of the drawing in FIG. 11. One end thereof is screwed on by means of the holes 30 with the screws 31 in the lowermost part of the vertically adjustable tube 3 and the force-transmitting means extends downwards between the flat bar 7 and one of the inner walls of the lower vertical tube 2, then via a radially designed guide 17 with an inner radial guide 19 and an outer radial guide 18 giving the force-transmitting means 20 a suitable radius of curvature to obtain minimal frictional resistance. The force-transmitting means 20 then furthermore runs backwards in the foot 1 and this entire horizontal travel is controlled both upwards and downwards and in the lateral direction by the guides 24 and 28 which are in this case part of the tubular section 1 that can be manufactured by the extrusion of aluminium. The rectangular holes 29 (FIG. 11) punched out of the force-transmitting means 20 together serve as a flexible transmission and also serve as a gear rack in that the teeth on the gear wheel 23 partly go through the holes 29 so that the gear wheel 23 rotates when the force-transmitting means 20 moves. When the bar 4 and the upper tube 3 and its integral components are displaced upwards, the horizontal part of the force-transmitting means 20 moves to the right, the gear wheel 23 rotating in an anti-clockwise direction. The smaller gear wheel 22 connected to the gear wheel 23 and rotating about the same axle 40 then drives the rack 21 together with its mounting plate 26 on the counterweight 25 towards the left by a shorter distance than the distance by which the bar is displaced upwards. The difference between the distance by which the bar is displaced and the shorter distance by which the counterweight is displaced can be adjusted in a simple manner by selecting the difference in the diameter of the two gear wheels 22 and 23 so as to allow for the most constant overturning resistance possible between the highest and lowest set heights of the bar. FIG. 4 shows the position 20*a* for the end of the force-transmitting means 20 when the bar is situated in its highest position and FIG. 5 shows the position 20*b* for the end of the force-transmitting means 20 when the bar is situated in its lowest position.

The stop lug 8 secured to the flat bar 7 prevents the tube 3 from being raised too high in that the tube 14 contacts the stop lug 8 when the bar 4 is situated at its highest adjustable height.

The counterweight 25 and the mounting plate 26 together serve as a completely movable counterweight weighing a total of approximately 2.5-3 kg. The counterweight 25 slides on top of the sections 24 and 28 forming part of the tube 1 with a spacer therebetween consisting of a felt material 44 secured below the counterweight and easily sliding on top of the sections 24 and 28 (forming part of the tube 1). The screw 33 prevents the rack 21 from being raised upwards and thus coming into contact with the cog wheel 22.

The positions 36-38 are closing caps, in this case made of plastic, to protect the contents of the tubes from dust and moisture.

A plastic bearing 39 which is square and hollow and four plastic washers 41 together serve as bearings between the tubes 2-3. Only two of the four plastic washers are shown in FIGS. 4-7 so as not to hide the lower part of the tension spring 10. Each of the washers 41 is secured to the lower part of the tube 3 on all four sides.

POSSIBLE MODIFICATIONS OF THE INVENTION

The force-transmitting means 20, which in this case consists of a metal strip of what is referred to as spring steel having a thickness of approximately 0.4 mm, may also conceivably be made of any highly flexible plastic material, in which case it probably has a slightly increased thickness.

The rectangular holes 29 in the force-transmitting means 20 may also conceivably be replaced by projecting teeth adapted to any type of cog wheel, in such a case replacing the cog wheel 23.

The gear rack 21 and the gear wheels 22-23 are in this case made of plastic, but may also conceivably be made of any type of metal.

The counterweight 25 has a sliding bearing 44 consisting of a felt material. The material can be replaced by any other material that slides easily relative to the supporting surface. Many types of plastic are suitable to this end.

The invention claimed is:

1. A hurdle for hurdle racing, comprising:

two hollow base parts (1) arranged at a distance from one another and adapted to rest on a supporting surface, each base part comprising a hollow space;

a counterweight (25) displaceably arranged in each base part (1);

a driver means (21) for the counterweight (25);

a gear transmission (22, 23, 40) arranged in each base part (1) and operatively connected to displace the counterweight (25);

tubular elements (2, 3), each tubular element comprising a first tube (2) and a second tube (3) displaceable telescopically relative to one another, the first tube (2) and the second tube (3) extending vertically in relation to the supporting surface, each of the first tubes (2) being fixed to one end of an associated one of the base parts (1); locking elements (9, 10, 13, 15) that lock the first and second tubes (2, 3) relative to one another;

a bar (4) connecting upper ends of the second tubes (3) situated furthest away from the associated base part (1);

a strip-type force-transmitting means (20) that extends from the hollow space in each base part (1) and is connected to an associated second tube (3), the strip-type force transmitting means (20) provided with openings (29); and guides (24, 28) arranged in each base part (1), wherein the gear transmission (22, 23, 40) engages both with the strip-type force-transmitting means (20) and with the driver means (21) for the counterweight (25), wherein the strip-type force-transmitting means (20) is received in the guides (24, 28), and wherein the gear transmission (22, 23, 40) is adapted to cooperate with the openings (29) provided in the strip-type force transmitting means (20).

2. The hurdle according to claim 1, wherein the gear transmission includes two cog wheels (22, 23) having different diameters.

3. The hurdle according to claim 2, wherein the driver means comprises a rack (21) and one (22) of the two cog wheels (22, 23) is adapted to cooperate with the rack (21).

4. The hurdle according to claim 3, wherein, the guides arranged in each base part are radial guides, and the radial guides (18, 19) are arranged at a transition between each first tube and the associated one of the base parts (1).

5. The hurdle according to claim 3, further comprising stationary parts (7) having holes, wherein each of the stationary parts (7) having holes (13) is mounted stationary to a respective one of the second tubes (3), and wherein the locking elements that lock the telescopic first and second tubes (2, 3) relative to one another comprise locking pins (9) that cooperate with the holes (13) in the stationary part (7).

6. The hurdle according to claim 3, wherein the locking elements include a spring-loaded locking arm (15) which can assume an active position and an inactive position.

7. The hurdle according to claim 2, wherein, the guides arranged in each base part are radial guides, and the radial guides (18, 19) are arranged at a transition between each first tube and the associated one of the base parts (1).

8. The hurdle according to claim 2, further comprising stationary parts (7) having holes, wherein each of the stationary parts (7) having holes (13) is mounted stationary to a respective one of the second tubes (3), and wherein the locking elements that lock the telescopic first and second tubes (2, 3) relative to one another comprise locking pins (9) that cooperate with the holes (13) in the stationary part (7).

9. The hurdle according to claim 2, wherein the locking elements include a spring-loaded locking arm (15) which can assume an active position and an inactive position.

10. The hurdle according to claim 1, wherein, the guides arranged in each base part are radial guides, and the radial guides (18, 19) are arranged at a transition between each first tube and the associated one of the base parts (1).

11. The hurdle according to claim 10, further comprising stationary parts (7) having holes, wherein each of the stationary parts (7) having holes (13) is mounted stationary to a respective one of the second tubes (3), and wherein the locking elements that lock the telescopic first and second tubes (2, 3) relative to one another comprise locking pins (9) that cooperate with the holes (13) in the stationary part (7).

12. The hurdle according to claim 1, further comprising stationary parts (7) having holes, wherein each of the stationary parts (7) having holes (13) is mounted stationary to a respective one of the second tubes (3), and wherein the locking elements that lock the telescopic first and second tubes (2, 3) relative to one another comprise locking pins (9) that cooperate with the holes (13) in the stationary part (7).

13. The hurdle according to claim 12, wherein the stationary part is a flat bar (7) and the flat bar (7) is arranged in a closed space within the tubular element (2, 3).

14. The hurdle according to claim 1, wherein the locking elements include a spring-loaded locking arm (15) which can assume an active position and an inactive position.

15. The hurdle according to claim 1, wherein the force-transmitting means (20) is a strip of spring steel.

* * * * *